US009903608B2

(12) United States Patent
Lee et al.

(10) Patent No.: US 9,903,608 B2
(45) Date of Patent: Feb. 27, 2018

(54) APPARATUS FOR OPENING AND CLOSING DISCHARGE PORT AND AIR CONDITIONER HAVING THE SAME

(71) Applicant: SAMSUNG ELECTRONICS CO., LTD., Suwon-si (KR)

(72) Inventors: Won-Hee Lee, Busan (KR); Tae Duk Kim, Yongin-si (KR); Yun Suk Park, Suwon-si (KR); Moon-Sun Shin, Suwon-si (KR); Hae Gyun Shin, Osan-si (KR); Weon Seok Choi, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 374 days.

(21) Appl. No.: 14/591,287

(22) Filed: Jan. 7, 2015

(65) Prior Publication Data

US 2015/0192323 A1 Jul. 9, 2015

(30) Foreign Application Priority Data

Jan. 8, 2014 (KR) ..... 10-2014-0002547

(51) Int. Cl.
*F24F 13/16* (2006.01)
*F24F 7/00* (2006.01)
(Continued)

(52) U.S. Cl.
CPC ..... *F24F 13/16* (2013.01); *F24F 7/00* (2013.01); *F24F 13/06* (2013.01); *F24F 13/10* (2013.01); *F24F 13/105* (2013.01)

(58) Field of Classification Search
CPC .... F24F 13/16; F24F 7/00; F24F 13/06; F24F 13/10; F24F 13/105; F24F 1/0011;
(Continued)

(56) References Cited

U.S. PATENT DOCUMENTS 2,307,273 A 1/1943 Hughes
4,188,862 A * 2/1980 Douglas, III ..... F16K 3/314 251/212

(Continued)

FOREIGN PATENT DOCUMENTS

CN 103388895 11/2013
CN 103388895 A * 11/2013

(Continued)

OTHER PUBLICATIONS

International Search report dated Apr. 14, 2015 in International Patent Application No. PCT/KR2015/000188.

(Continued)

*Primary Examiner* — Gregory Huson
*Assistant Examiner* — Elizabeth M May
(74) *Attorney, Agent, or Firm* — Staas & Halsey LLP

(57) ABSTRACT

An air conditioner including an opening and closing apparatus configured to open/close a discharge port for discharging air into an indoor space, the opening and closing apparatus includes a plurality of covers provided with a guide unit, a guide plate provided with a spiral guide hole alternately formed with a guide hole having a first section and a second section, and a rail plate extended in a radial direction and having a plurality of rails through which the guide unit is inserted. When the guide plate is rotated, the plurality of covers are moved in a radial direction while having a time interval with respect to the adjacent cover as to open/close the discharge port.

28 Claims, 11 Drawing Sheets

(51) Int. Cl.
*F24F 13/06* (2006.01)
*F24F 13/10* (2006.01)

(58) Field of Classification Search
CPC ..... F24F 13/1426; F24F 1/0014; F24F 2001/004; F16L 55/10
USPC ..... 454/335, 347, 358, 334, 310
See application file for complete search history.

(56) References Cited

U.S. PATENT DOCUMENTS

| | | | | |
|---|---|---|---|---|
| 6,105,461 | A * | 8/2000 | Bauer | B60H 1/0065 74/502 |
| 7,326,108 | B2 * | 2/2008 | Matthews | F24F 7/065 454/259 |
| 2007/0066215 | A1 * | 3/2007 | Song | B01D 46/0004 454/329 |

FOREIGN PATENT DOCUMENTS

| | | |
|---|---|---|
| DE | 1183324 | 12/1964 |
| EP | 1046842 | 10/2000 |
| EP | 1767873 | 3/2007 |
| EP | 1531307 | 5/2009 |
| FR | 1190728 | 10/1959 |
| GB | 2438761 | 12/2007 |
| JP | 2004-85115 | 3/2004 |
| JP | 2007-040628 | 2/2007 |
| JP | 2010-285925 | 12/2010 |
| JP | 2013-124805 | 6/2013 |
| KR | 20-1998-0061642 | 11/1998 |
| KR | 10-1999-0080578 | 11/1999 |
| KR | 10-2011-0016279 | 2/2011 |
| KR | 10-2012-0120359 | 11/2012 |

OTHER PUBLICATIONS

Extended European Search Report dated May 19, 2015 in European Patent Application No. 15150288.7.
European Office Action dated Feb. 14, 2017 in European Patent Application No. 15150288.7.
European Office Action dated Oct. 12, 2017 in European Patent Application No. 15150288.7.

* cited by examiner

APPARATUS FOR OPENING AND CLOSING DISCHARGE PORT AND AIR CONDITIONER HAVING THE SAME

CROSS-REFERENCE TO RELATED APPLICATIONS

This application claims the benefit of the Korean Patent Application No. 10-2014-0002547, filed on Jan. 8, 2014 in the Korean Intellectual Property Office, the disclosure of which is incorporated herein by reference.

BACKGROUND

1. Field

Embodiments of the present disclosure relate to an apparatus for opening and closing a discharge port, and an air conditioner having the same.

2. Description of the Related Art

An air conditioner is an apparatus configured to maintain a temperature of indoor air in a comfortable manner by use of a freezing cycle for suitable activities of a human being. A conventional air conditioner is capable of cooling or heating the air at the surroundings of a heat exchanger according to phase changes of a refrigerant that flows at an inside of the heat exchanger, and accordingly, by discharging the cooled or heated air to an indoor space, is also capable of properly maintaining the temperature of the indoor space.

The air conditioner as such is provided with a freezing cycle during which a refrigerant is configured to flow in a forward or backward direction through a compressor, a condenser, an expansion valve, and an evaporator. The compressor is configured to provide a refrigerant in a state of gas at a high temperature and a high pressure, while the condenser is configured to provide a refrigerant in a state of liquid at a room temperature and a high pressure. The expansion valve is configured to decompress the refrigerant in a state of liquid at a room temperature and a high pressure, and the evaporator is configured to evaporate the decompressed refrigerant into a state of gas at a low temperature.

The air conditioner may be divided into a separate type air conditioner provided with an outdoor unit separately provided from an indoor unit, and an integrated type air conditioner provided with an outdoor unit integrally provided with an indoor unit. In a case of the separate type air conditioner provided with an outdoor unit separately provided from an indoor unit, in general, the compressor and the condenser, that is, an outdoor heat exchanger, are provided at the outdoor unit, while the evaporator, that is, an indoor heat exchanger, is provided at the indoor unit. A refrigerant may be able to flow through the outdoor unit and the indoor unit in a circulated manner through pipes connecting the outdoor unit and the indoor unit.

A discharge port is provided at a front surface of the indoor unit, and the air having been subjected to heat exchange by the phase change of refrigerant may be discharged to an indoor space though the discharge port.

SUMMARY

Therefore, it is an aspect of the present disclosure to provide an apparatus for opening and closing a discharge port having the width of an opening of the discharge port thereof varied as a plurality of covers configured to cover the discharge port are sequentially moved, and an air conditioner having the same.

Additional aspects of the disclosure will be set forth in part in the description which follows and, in part, will be obvious from the description, or may be learned by practice of the disclosure.

In accordance with one aspect of the present disclosure, an apparatus for opening and closing a discharge port having a circular shape and discharging air, the apparatus includes a plurality of covers. The plurality of covers may be configured to move in a radial direction of the discharge port while covering at least a portion of the discharge port. A width of an opening of the discharge port may be varied as the plurality of covers are sequentially moved.

The apparatus may further include a first group of a plurality of covers configured to simultaneously move in a radial direction of the discharge port.

The plurality of covers belonging to the first group may be symmetrically positioned to each other with respect to a center of the discharge port.

The apparatus may further include a second group of a plurality of covers configured to simultaneously move in a radial direction of the discharge port. The width of the opening of the discharge port may be varied as the second group of covers is moved sequentially after the first group of covers is moved.

The cover may at least partially overlap other covers adjacent to the cover.

At the time when at least one of the plurality of covers is moved in the radial direction of the discharge port, the distance in between the discharge port and the at least one cover may become closer or farther.

The apparatus may further include a motor configured to provide a driving force such that the plurality of covers are moved.

The apparatus may further include a gear part configured to change the speed of the motor.

The apparatus may further include a guide plate configured to move the cover as the guide plate is rotated by receiving a rotational force of the motor.

A plurality of guide holes corresponding to the plurality of covers, respectively, may be formed at the guide plate, and a guide part passing through the guide hole may be formed at the cover.

At least one of the guide holes may include a first section extended along an arc concentric to the discharge port, and a second section extended from the first section toward a center of the arc. If the guide part is positioned within the first section when the guide plate is rotated, the cover is not moved, and if the guide part is positioned within the second section when the guide plate is rotated, the cover is moved.

The apparatus may further include a rail plate at which a plurality of rails corresponding to the plurality of covers, respectively, are formed to support the guide part of the cover.

In accordance with another aspect of the present disclosure, an air conditioner including a discharge port having a circular shape and discharging air and a plurality of covers to cover the discharge port is provided. Each of the plurality of covers may be configured to cover a certain region of the discharge port, at least two of the plurality of covers move from a first position capable of covering a region corresponding to the discharge port to a second position capable of opening the region corresponding to the discharge port, and at the time of when a first cover of the moving covers is moved from the first position to the second position, a second cover of the moving covers may be controlled not to be moved.

The first cover may be configured to move in a radial direction of the discharge port.

The first cover may start to move from the first position to the second position, and sequentially the second cover starts to move.

Each of the plurality of covers may be able to move from the first position to the second position.

The air conditioner may further include a first group of a plurality of covers that are simultaneously moved.

The plurality of covers belonging to the first group may be symmetrically positioned to each other with respect to a center of the discharge port.

Each of the plurality of covers may move in a radial direction of the discharge port.

When the first cover moves in a radial direction of the discharge port, a distance in between the discharge port and the first cover may be farther or closer.

A distance in between the discharge port and the first cover when the first cover is at the second position may be closer than a distance in between the discharge port and the first cover when the first cover is at the first position.

In accordance with another aspect of the present disclosure, an air conditioner including a discharge port having a circular shape and discharging air and a plurality of covers to cover the discharge port is provided. Each of the plurality of covers may be provided with a first position capable of covering a region corresponding to the discharge port and a second position capable of entirely opening the region corresponding to the discharge port, and an overlapping area of adjacent covers of the plurality of covers when all the covers are placed at the second position is larger than an overlapping area of the adjacent covers of the plurality of covers when all the covers are placed at the first position.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
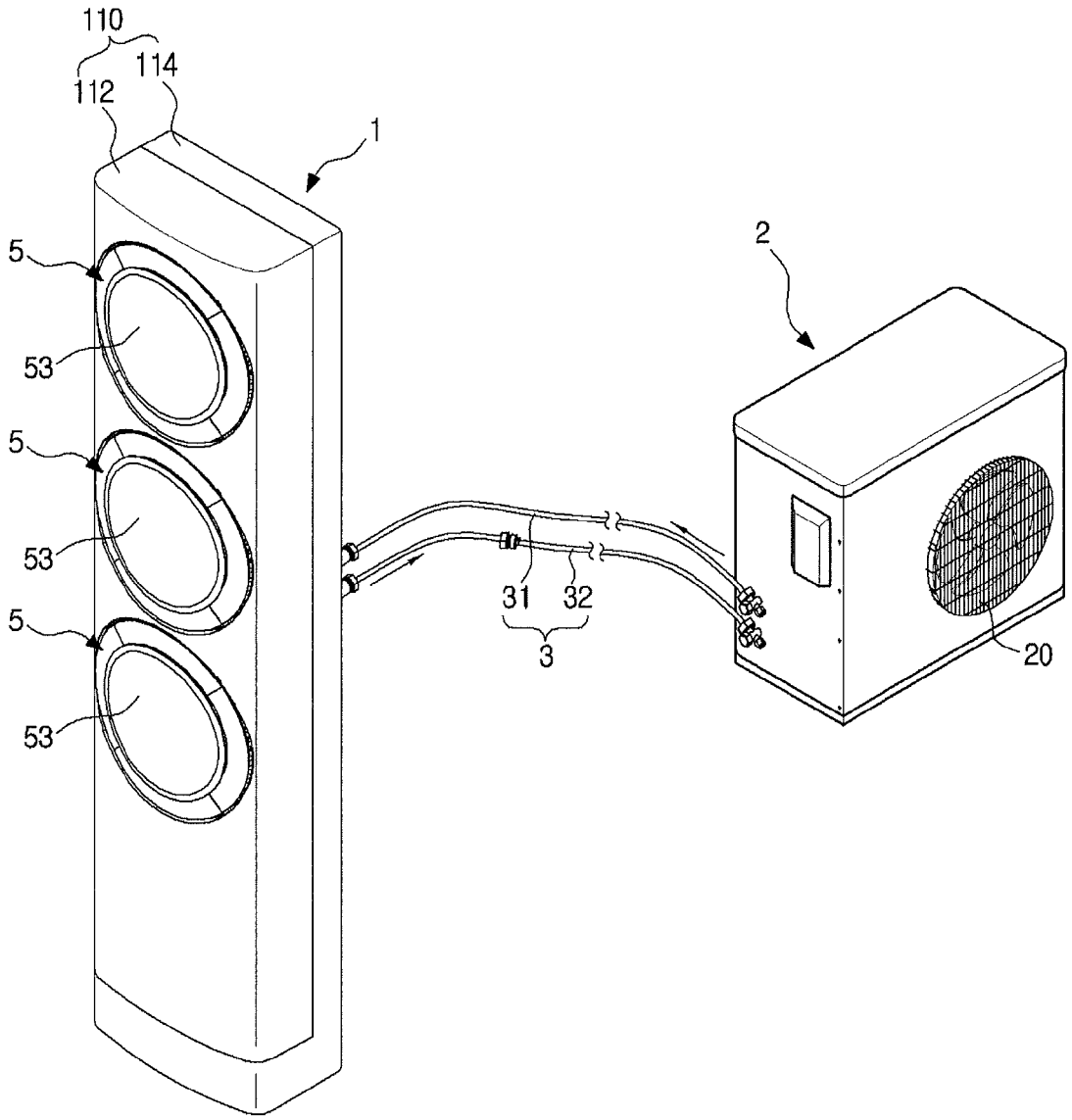
FIG. 1 is a drawing illustrating an air conditioner in accordance with one embodiment of the present disclosure.

Reference will now be made in detail to the embodiments of the present disclosure, examples of which are illustrated in the accompanying drawings, wherein like reference numerals refer to like elements throughout.

FIG. 1 is a drawing illustrating an air conditioner in accordance with one embodiment of the present disclosure.

Referring to FIG. 1, an air conditioner in accordance with one embodiment of the present disclosure includes an indoor unit 1 and an outdoor unit 2. The indoor unit 1 and the outdoor unit 2 may be connected to each other by use of a refrigerant pipe 3.

The refrigerant pipe 3 may include a first refrigerant pipe 31 and a second refrigerant pipe 32. The refrigerant that is condensed at the outdoor unit 2 may be moved to the indoor unit 1 through the first refrigerant pipe 31. The refrigerant that is heat-exchanged with respect to an indoor air at the indoor unit 1 may be moved to the outdoor unit 2 through the refrigerant pipe 32. As the above, the refrigerant may circulate within a refrigerant pipe (not shown) provided at the indoor unit 1 and a refrigerant pipe (not shown) provided at the outdoor unit 2 through the refrigerant pipe 3.

The indoor unit 1 may be able to maintain a temperature of an indoor space by discharging the air that is heat-exchanged with respect to the refrigerant while the refrigerant is compressed and condensed at the outdoor unit 2. The indoor unit 1 may include an expansion valve and an evaporator. As the air, which is cooled by the refrigerant that is evaporated at the evaporator, is discharged into an indoor space, the air at the indoor space may be cooled. A fan assembly 4 (see FIG. 5) may be provided at the indoor unit 1 so that the air cooled by the refrigerant may be easily discharged into the indoor space. An apparatus for opening and closing a discharge port 5 may be provided at a front of the fan assembly 4.

The outdoor unit 2 may include a compressor, a condenser, and a blower fan 20. An air inlet port through which an outside air may be introduced or discharged may be formed at one side of the outdoor unit 2. The compressor is configured to compress a refrigerant, and the compressed refrigerant is introduced to the condenser and then condensed. At this time, the blower fan 20 is driven, and the outside air that is introduced through the air inlet port may be able to cool the heat that is generated from the condenser.

Figure 2:
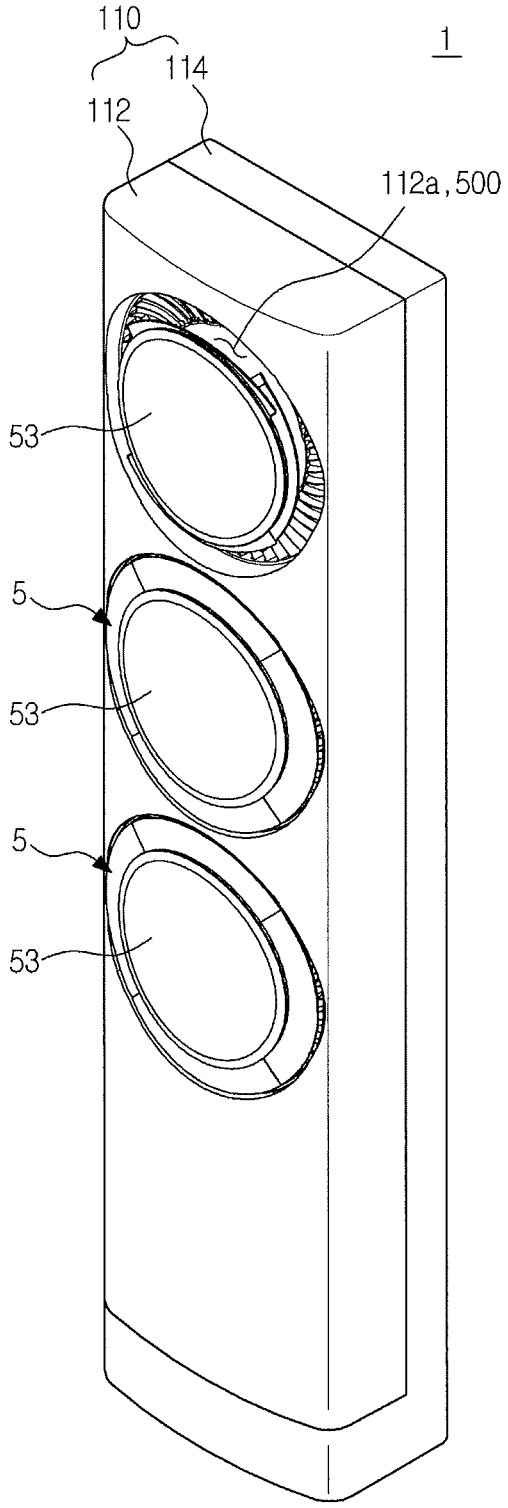
FIG. 2 is a drawing illustrating an indoor unit of the air conditioner in accordance with one embodiment of the present disclosure.
Figure 3:
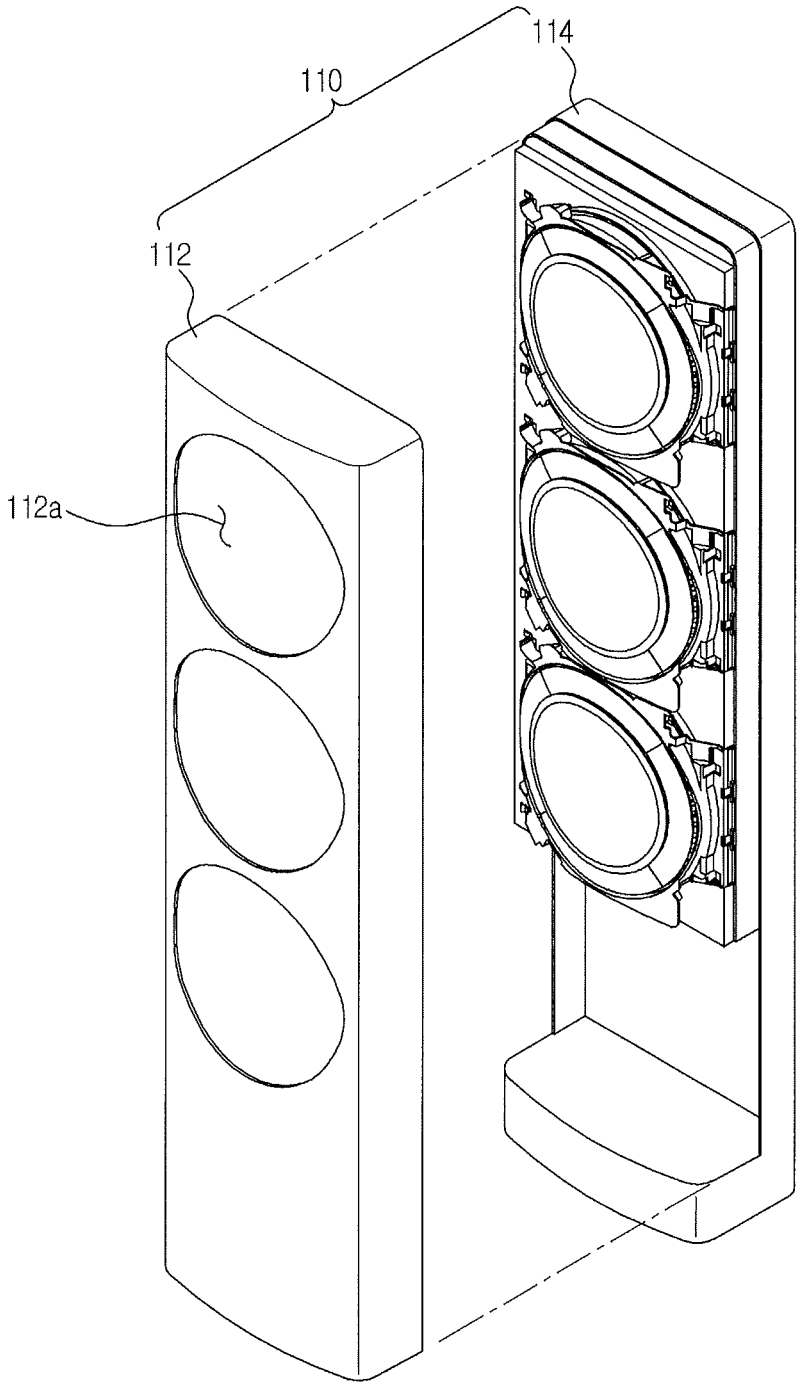
FIG. 3 is a drawing illustrating a state when a front surface panel of the indoor unit is separated in accordance with one embodiment of the present disclosure.
Figure 4:
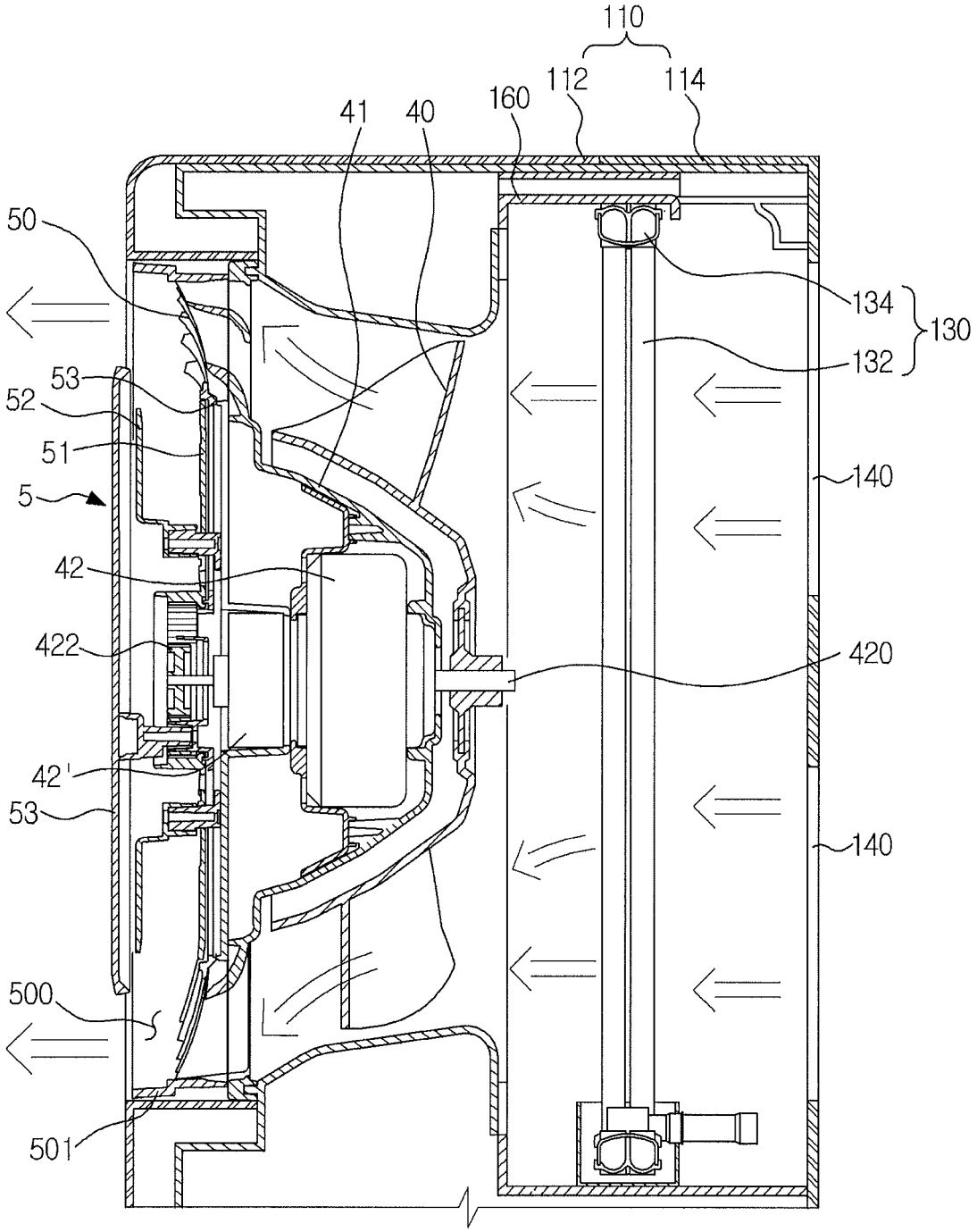
FIG. 4 is a cross-sectional view illustrating a portion of the indoor unit in accordance with one embodiment of the present disclosure.
Figure 5:
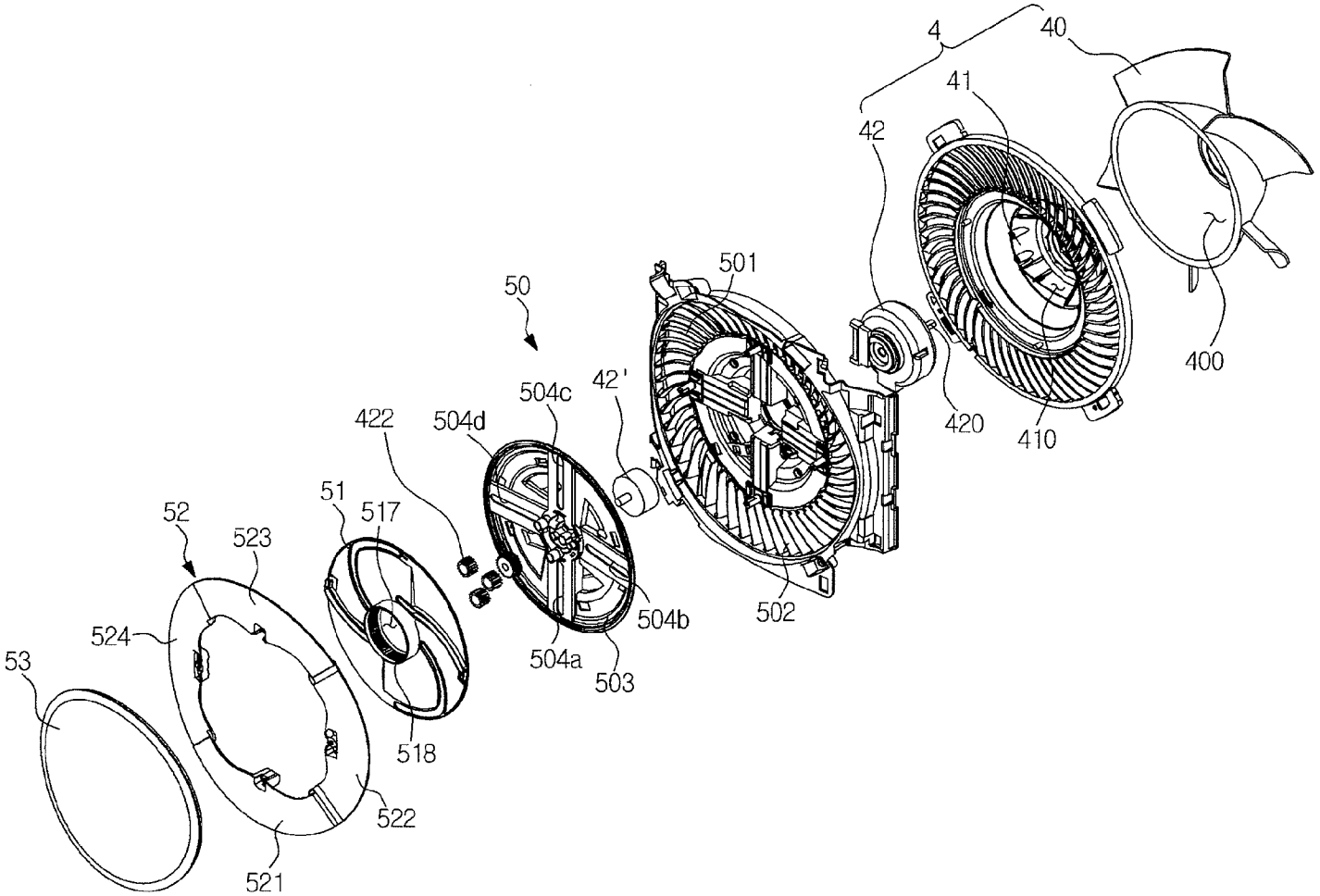
FIG. 5 is an exploded perspective view illustrating a portion of the indoor unit in accordance with one embodiment of the present disclosure.
Figure 6:
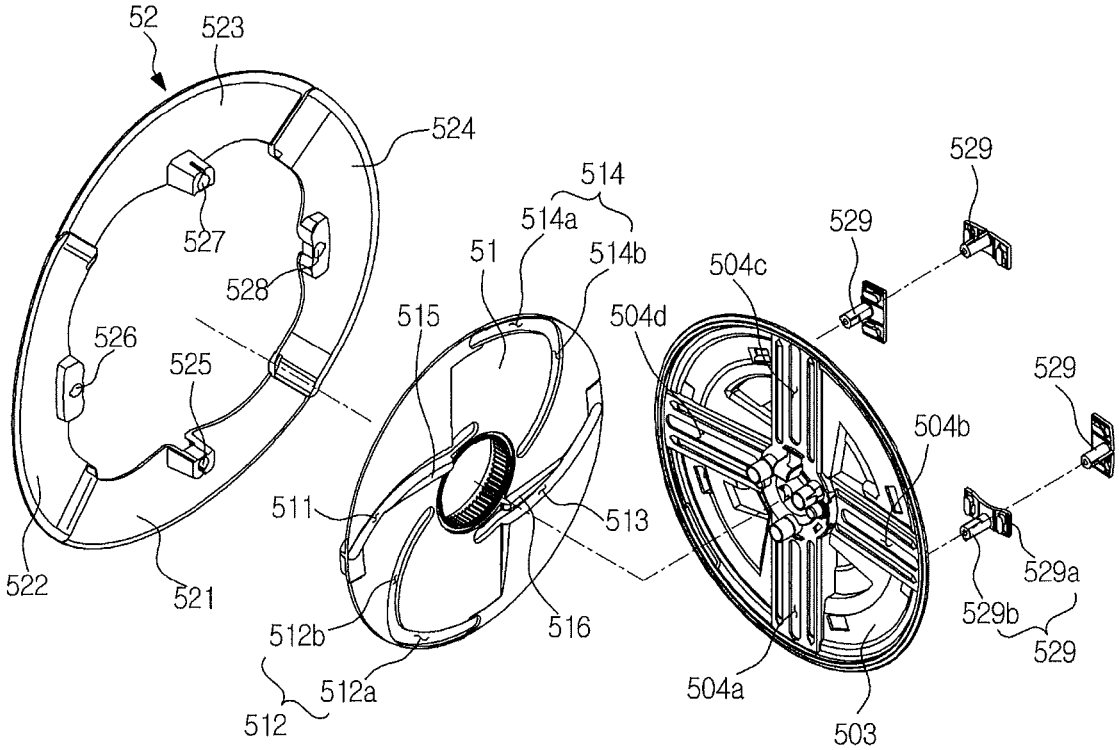
FIG. 6 is an exploded perspective view illustrating a discharge port opening and closing apparatus in accordance with one embodiment of the present disclosure.
Figure 7:
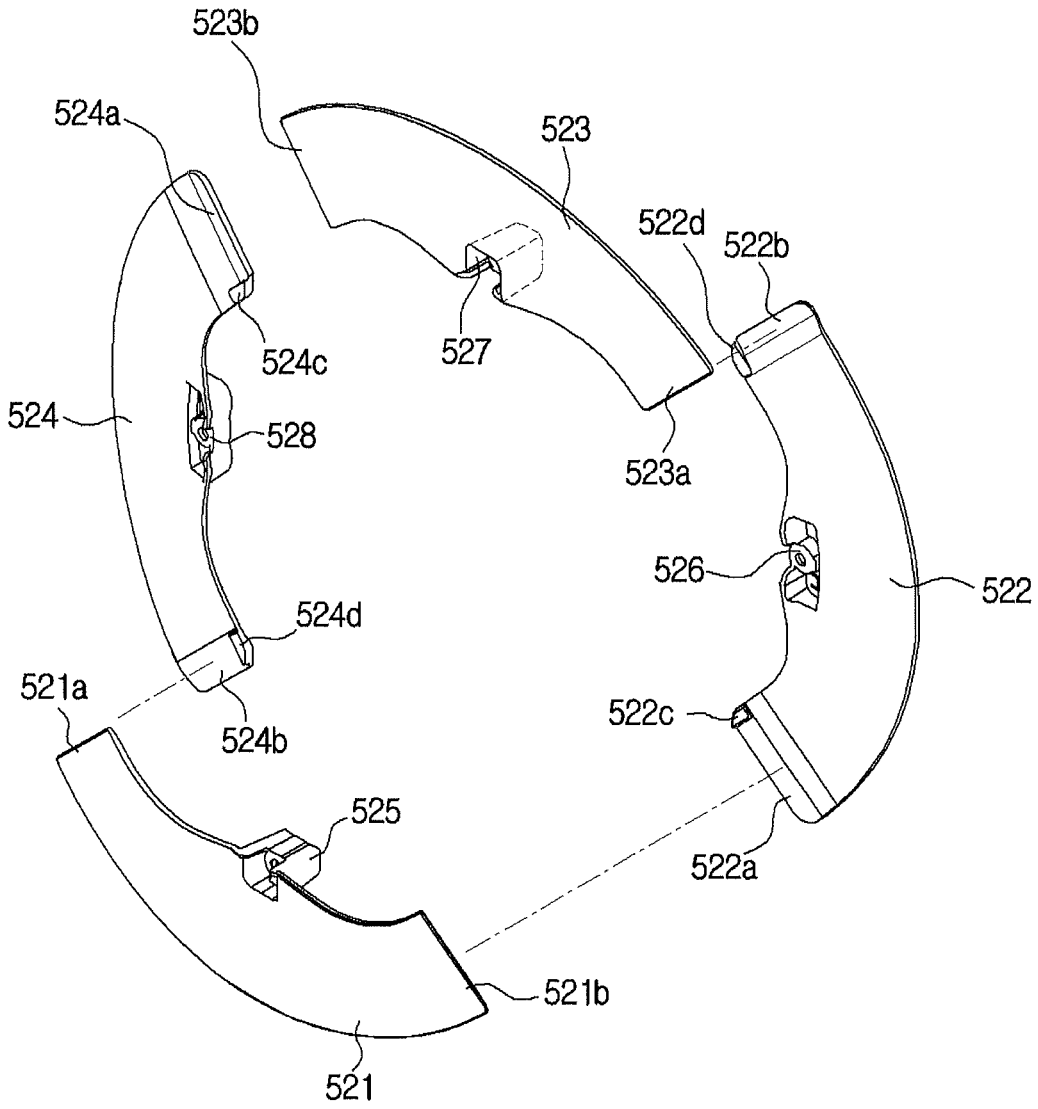
FIG. 7 is a drawing illustrating a bottom surface of a cover of the discharge port opening and closing apparatus in accordance with one embodiment of the present disclosure.

FIG. 2 is a drawing illustrating the indoor unit of the air conditioner in accordance with one embodiment of the present disclosure, FIG. 3 is a drawing illustrating a state when a front surface panel of the indoor unit is separated in accordance with one embodiment of the present disclosure, FIG. 4 is a cross-sectional view illustrating a portion of the indoor unit in accordance with one embodiment of the present disclosure, FIG. 5 is an exploded perspective view illustrating a portion of the indoor unit in accordance with one embodiment of the present disclosure, FIG. 6 is an exploded perspective view illustrating the discharge port opening and closing apparatus in accordance with one embodiment of the present disclosure, and FIG. 7 is a drawing illustrating a lower surface of a cover of the discharge port opening and closing apparatus in accordance with one embodiment of the present disclosure.

Referring to FIGS. 2 to 7, the indoor unit 1 in accordance with one embodiment of the present disclosure includes a housing 110 forming an exterior appearance of the indoor unit 1, the discharge port opening and closing apparatus 5 disposed in the housing 110, the fan assembly 4 provided at a rear of the discharge port opening and closing apparatus 5, at least one heat exchanger 130 disposed at a rear of the fan assembly 4, and an inlet port 140 provided at a rear of the housing 110.

At least one heat exchanger 130 may be provided at an inside the indoor unit 1. The heat exchanger 130 may be disposed in between the fan assembly 4 and a rear surface panel 114. The heat exchanger 130 may be installed at an inside the indoor unit 1 by use of a fixing bracket 160. The heat exchanger 130 may be able to absorb heat from air that is introduced through the inlet port 140 or deliver heat to the air that is introduced through the inlet port 140.

The heat exchanger 130 may include a tube 132, a header 134, and a plurality of heat exchanging fins (not shown). The header 134 is connected to one side or to end portions of the both sides of the tube 132. A refrigerant pipe that is connected to the refrigerant pipe of the outdoor unit 2 is connected to the header 134, and may be able to introduce/discharge refrigerant to/from the tube 132. The plurality of heat exchanging fins is mounted at the tube 132, and may be able to enhance the heat exchanging efficiency of the heat exchanger 130.

The housing 110 includes a front surface panel 112 and the rear surface panel 114. A discharge port 112*a* is formed at the front surface panel 112. The discharge port 112*a* may be formed in the shape of a circle. The air that is introduced through the fan assembly 4 may be discharged through the discharge port 112*a*. The rear surface panel 114 is coupled to a rear of the front surface panel 112 to form a rear surface of the indoor unit. A plurality of inlet ports 140 may be provided at the rear surface panel 114.

The fan assembly 4 may be positioned at a rear of the front surface panel 112. The fan assembly 4 is disposed at a front of the heat exchanger 130, and is configured to discharge the air that is heat-exchanged at the heat exchanger 130 through the discharge port 112*a*.

The fan assembly 4 includes a fan 40, a motor cover 41, and a motor 42. The fan 40 may be a mixed flow fan that is rotatable by the motor 42.

The fan 40 may be provided with an accommodating space 400 allowing the motor cover 41 to be inserted thereinto. The motor cover 41 may be provided with a motor accommodating part 410 allowing the motor 4 to be inserted thereinto. The motor accommodating part 410 may be provided in a way to have a space that is protruded toward a rear. The motor 42 is accommodated at the motor accommodating part 410. The motor cover 41 may be interposed in between the motor 42 and the fan 40. A space surrounding the motor accommodating part 410 may be provided at one side of the fan 40.

A shaft 420 configured to rotate by being delivered with a driving force from the motor 42 is provided at one side of the motor 42, and the fan 40 may be mounted at the shaft 420 as the shaft 420 is penetrated through the motor cover 41. Accordingly, the fan 40 may rotate by receiving a driving force from the motor 42. The shaft 420 provided at the motor 42 may be disposed in a way to face the rear surface panel 114.

A gear part 422 configured to tooth-couple with respect to a guide plate 51 included in the discharge port opening and closing apparatus 5 may be formed at the other side of the motor 42. As the motor 42 is rotated, the guide plate 51 may be able to be rotated by the driving force of the motor 42.

The air that is introduced into an inside the indoor unit 1 through the inlet port 140 by use of the fan assembly 4 may be discharged through the discharge port 112*a* formed at the front surface panel 112. The discharge port 112*a* may be open/closed by the discharge port opening and closing apparatus 5.

The discharge port opening and closing apparatus 5 may include a diffuser assembly 50, the guide plate 51, and a motor 42' configured to provide a driving force to a plurality of covers 52 and the guide plate 51. A rail plate 503 may be provided at one side of the diffuser assembly 50. The guide plate 51 is provided at a front of the diffuser assembly 50. The plurality of covers 52 may be provided at a front of the guide plate 51 in a way to be moved in a radial direction of the guide plate 51. A discharge port cover 53 may be provided at a front of the guide plate 51. By use of the discharge port cover 53, the ring-shape of the discharge port 112*a* corresponding to a discharge port 500, which is to be described later, provided at the diffuser assembly 50 may be selectively exposed, while the discharge port 112*a* is formed at the front surface panel 112 of the indoor unit 1. Hereinafter, the discharge port is referred to as the discharge port 500 provided at the diffuser assembly 50.

The diffuser assembly 50 may be disposed at a front of the fan assembly 4. The diffuser assembly 50 includes the discharge port 500 having the shape of a ring and a discharge guide part 501 having the shape of a circle while formed along the circumference of the discharge port 500. A plurality of guide vanes 502 configured to guide the flow of the air that is being discharged through the discharge port 500 may be provided at the discharge port 500. The guide vanes 502 may be formed in a way to radially intersect an inner side of the discharge guide part 501.

The diffuser assembly 50 may be provided in a way to be exposed through the discharge port 112*a* that is provided at the front surface panel 112. The diffuser assembly 50 is configured in a way to have the air discharged to a front of the front surface panel 112 through the discharge port 112*a* that is formed at the front surface panel 112, as the air is passed through the fan assembly 4.

The discharge port 500 formed at the diffuser assembly 50 may be open/closed by the discharge port opening and closing apparatus 5. The discharge port opening and closing apparatus 5 includes the rail plate 503, the guide plate 51, and the cover 52.

The cover 52 may be able to open/close the discharge port 500 by moving in a radial direction of the rail plate 503. The cover 52 may include a plurality of covers. In the present disclosure, while an example of having the total of four covers 521, 522, 523, and 524 is illustrated, the number of the covers may be sufficient with two units of the covers or with greater than two units of the covers, and the total number of units of the covers is not needed to be an even number. In addition, in the present disclosure, while a description of an example is provided that the left, right, upper, and lower areas of the discharge port is divided into four areas by the each of the four covers, the size of the each cover may be different to each other, and also the each of the covers may be provided in a way to cover a random area of the discharge port instead of the left, right, upper, and lower areas of the discharge port.

A first cover 521 and a third cover 523 each is provided with an approximately identical shape with respect to each other, and are symmetrically positioned with one another with respect to a center of the discharge port 500. Step portions 521*a*, 521*b*, 523*a*, and 523*b* are formed at both end portions of each of the first cover 521 and the third cover 523. The step portions 521*a*, 521*b*, 523*a*, and 523*b* are placed on mounting portions 522*a*, 522*b*, 524*a*, and 524*b* formed at both end portions of a second cover 522 and a fourth cover 524, both of which are to be described later, thereby defining a region overlapped in between adjacent covers in a state of when the discharge port 500 is covered by the covers 521, 522, 523, and 524.

The second cover 522 and the fourth cover 524 positioned at both sides of the first cover 521 and the third cover 523 each is provided with an approximately identical shape with respect to each other. The mounting portions 522*a*, 522*b*, 524*a*, and 524*b* are formed at both end portions of the second cover 522 and the fourth cover 524. At the mounting portions 522*a*, 522*b*, 524*a*, and 524*b*, the step portions 521*a*, 521*b*, 523*a*, and 523*b* of the first cover 521 and the third cover 523, which are described above, are mounted in a state of when the discharge port 500 is covered by the covers 521, 522, 523, and 524. When the cover 52 is positioned at a front side of the indoor unit 1, the step portions 521*a*, 521*b*, 523*a* and 523*b* are positioned at a front of the mounting portions 522*a*, 522*b*, 524*a* and 524*b*.

Thus, in a state of when the discharge port 500 is covered by the cover 52, front surfaces of the first cover 521, the second cover 522, the third cover 523, and the fourth cover 524 form a smooth surface without being disconnected.

Guide parts 525, 526, 527, and 528 may be provided at a rear surface of the cover 52. The guide parts 525, 526, 527, and 528 include the first guide part 525, the second guide part 526, the third guide part 527, and the fourth guide part 528 that are formed at central portions of each of the covers 521, 522, 523, and 524, respectively. Each of the first guide part 525, the second guide part 526, the third guide part 527, and the fourth guide part 528 is protruded toward the discharge port 500 from the central portion of each of the covers 521, 522, 523, and 524, and is configured to penetrate through guide holes 511, 512, 513, and 514, respectively, provided at the guide plate 51, details of which are to be described later.

A supporting part 529 configured to penetrate through the guide holes 511, 512, 513, and 514, respectively, may be mounted at the cover 52. The supporting part 529 may include a first supporting part 529*a* and a second supporting part 529*b*. The second supporting part 529*b* may be provided in a protruded manner from the first supporting part 529*a*. A groove is formed at each of the guide parts 525, 526, 527, and 528, and the second supporting part 529*b* may be inserted into the grooves after passing through rail holes 504*a*, 504*b*, 504*c*, and 504*d* and through the guide holes 511, 512, 513, and 514. The first supporting part 529*a* may be positioned at a rear of the rail plate 504.

The guide plate 51 may be positioned at a rear of the cover 52. The first guide hole 511, the second guide hole 512, the third guide hole 513, and the fourth guide hole 514 may be formed at the guide plate 51. The guide holes 511, 512, 513, and 514 may be extended from an external diameter of the guide plate 51 toward a central side of the guide plate 51. The guide holes 511, 512, 513, and 514 may be extended in the shape of a spiral.

The first guide part 525, the second guide part 526, the third guide part 527, and the fourth guide part 528 are configured to penetrate through the first guide hole 511, the second guide hole 512, the third guide hole 513, and the fourth guide hole 514, respectively.

A connecting hole 517 may be formed at a central portion of the guide plate 51. A teeth part 518 may be formed at an inner side surface of the guide plate 51 forming the connecting hole 517. The gear part 422 is provided at one side of the motor 42' and is inserted into the connecting hole 517. The gear part 422 may be tooth-coupled into the teeth part 518 formed at the inner side surface of the guide plate 51. As the gear part 422 provided at the motor 42' and the teeth part 518 formed at the inner side surface of the guide plate 51 are tooth-coupled with respect to each other, the driving force of the motor 42' may be delivered to the guide plate 51. The guide plate 51 may be rotated in a clockwise or counter-clockwise direction by the driving force of the motor 42'. A rotational speed of the motor 42' may be delivered to the guide plate 51 as the rotational speed of the motor 42' is varied by the gear ratio of the gear part 422 and the teeth part 518.

The first guide hole 511 and the third guide hole 513 each may be formed in the shape of a spiral hole that is extended from an outer circumferential end of the guide plate 51 toward a central portion of the guide plate 51. In a case when the guide plate 51 is rotated in a clockwise direction by being delivered with a driving force from the motor 42', a force is applied to the first guide part 525 and the third guide part 527 penetrating the first guide hole 511 and the third guide hole 513, respectively, and thus the first cover 521 and the third cover 523 are moved.

The rail plate 503 may be disposed at a central portion of the diffuser assembly 50. The discharge port 500 may be positioned at an outer side of the rail plate 503. A rail 504 extended in a radial direction of the rail plate 503 may be provided at the rail plate 503. The rail 504 may be able to guide radial movement of the cover 52.

The number of the rails 504 may be provided in a way to correspond to the number of the covers 52. The rail 504 is composed of a first rail 504*a*, a second rail 504*b*, a third rail 504*c*, and a fourth rail 504*d* that are configured to guide movements of the guide parts 525, 526, 527, and 528, respectively. The first guide part 525 and the fourth guide part 528 are penetrated through the first guide hole 511 and the fourth guide hole 514, respectively, and may be guided while inserted into the first rail 504*a* and the fourth rail 504*d*, respectively. According to the above, as the guide plate 51 is rotated, a force is applied to the first guide part 525, the second guide part 526, the third guide part 527, and the fourth guide part 528 by the guide holes 511, 512, 513, and 514 of the guide plate, respectively, and as the guide parts 525, 526, 527, and 528 are moved along the rails 504*a*, 504*b*, 504*c*, and 504*d*, and as a result, the covers 521, 522, 523, and 524 may be moved in a reciprocating manner in a radial direction of the rail plate 503.

Figure 8:
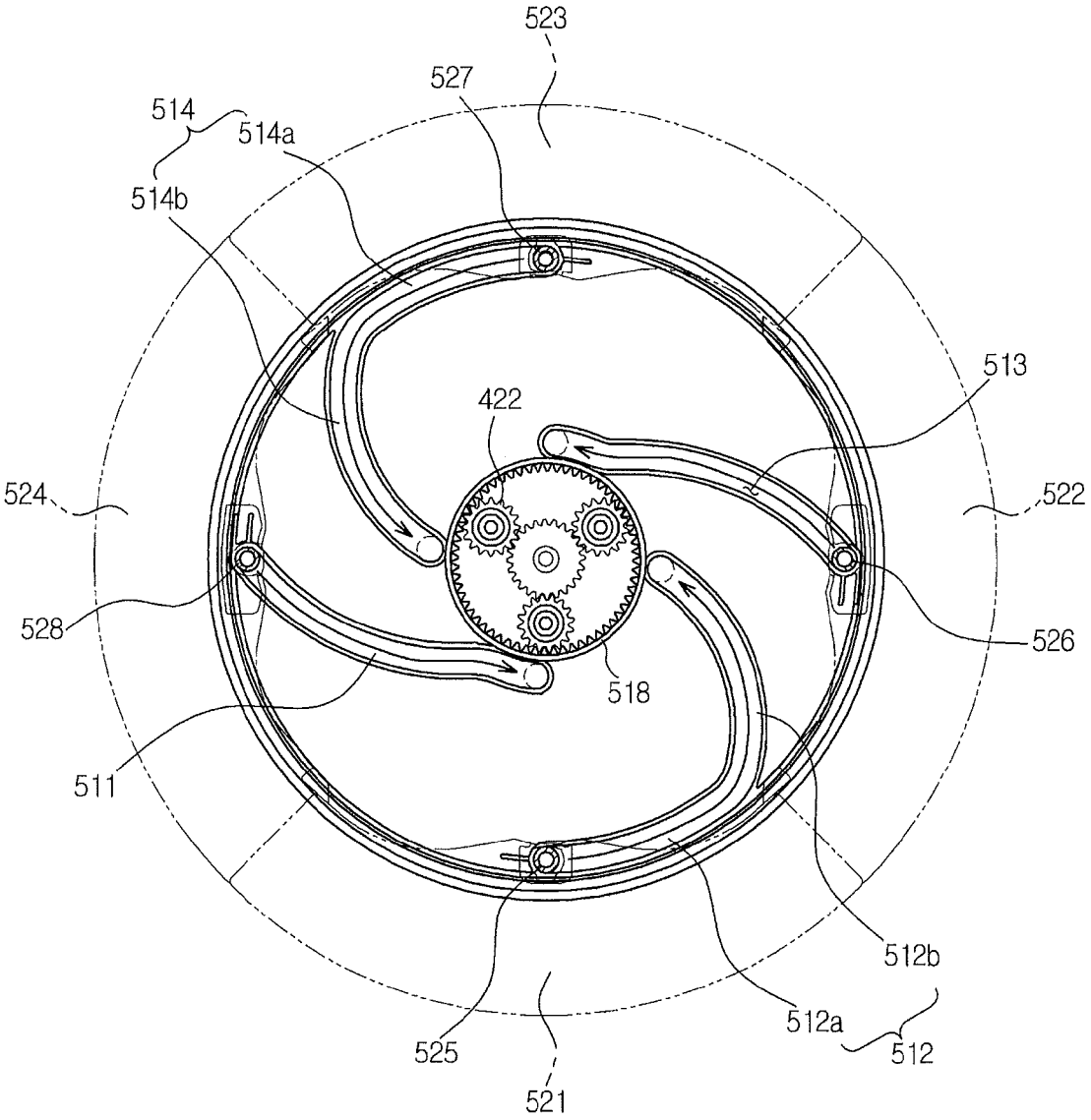
FIG. 8 is a drawing illustrating a moving path of a guide part of the discharge port opening and closing apparatus in accordance with one embodiment of the present disclosure.
Figure 9A:
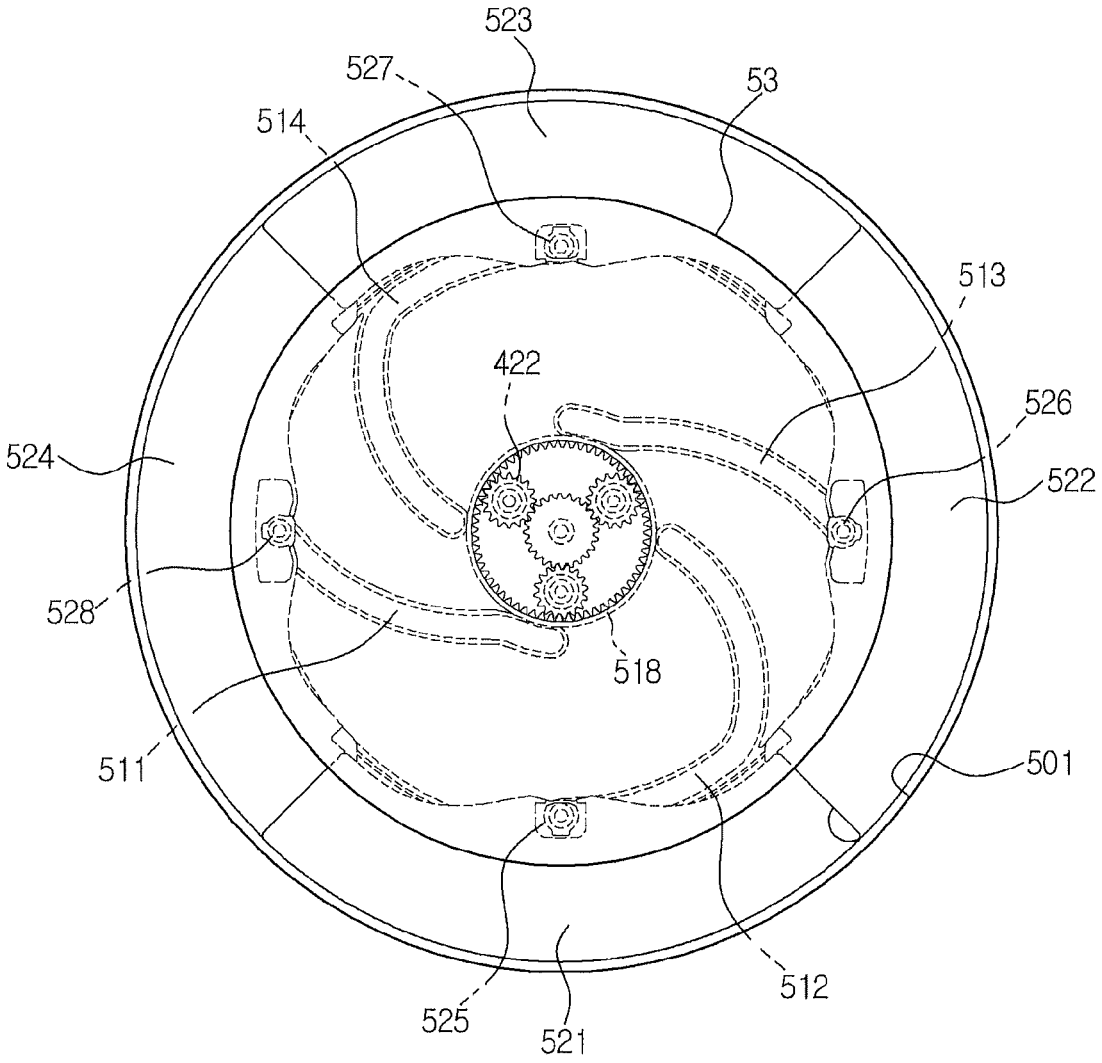
FIG. 9A is a drawing illustrating a discharge port closed by the discharge port opening and closing apparatus in accordance with one embodiment of the present disclosure.
Figure 9B:
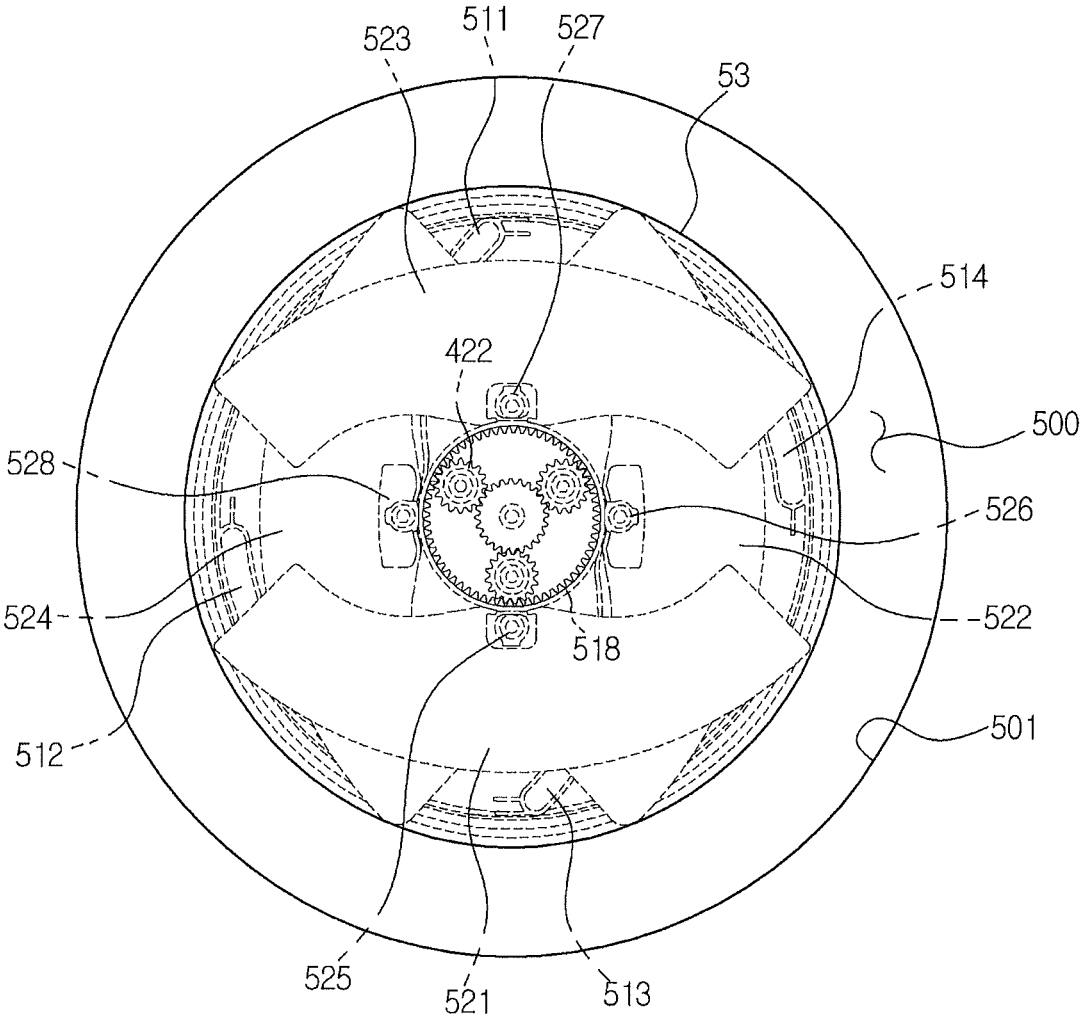
FIG. 9B is a drawing illustrating a discharge port open by the discharge port opening and closing apparatus in accordance with one embodiment of the present disclosure.

FIG. 8 is a drawing illustrating a moving path of the guide part of the discharge port opening and closing apparatus in accordance with one embodiment of the present disclosure, FIG. 9A is a drawing illustrating the discharge port closed by the discharge port opening and closing apparatus in accordance with one embodiment of the present disclosure, and FIG. 9B is a drawing illustrating the discharge port open by the discharge port opening and closing apparatus in accordance with one embodiment of the present disclosure.

Referring to FIG. 8 to FIG. 9B, the cover 52 of the discharge port opening and closing apparatus 5 in accordance with one embodiment of the present disclosure may be able to open/close the discharge port 500 as the guide plate 51 is rotated in a clockwise or counter-clockwise direction.

In a state when the discharge port 500 is closed as the cover 52 is positioned at an outer side of the guide plate 51, when the guide plate 51 is rotated in a clockwise direction by the motor 42', the cover 52 may be able to open the discharge port 500 by moving toward a central portion of the guide plate 51. In a state when the discharge port 500 is closed by the cover 52, a front surface of the cover 52 forms a smooth surface having no step difference.

In this case, the first cover 521 and the third cover 523 are moved toward a central portion of the guide plate 51 at the same time when the guide plate 51 is rotated. The first guide part 525 of the first cover 521 and the third guide part 527 of the third cover 523 are guided by the first rail 504*a* and the third rail 504*c*, respectively, and may be moved toward a central portion of the guide plate 51.

Even if the guide plate 51 is rotated, the second cover 522 is not moved as long as the second guide part 526 is positioned in a first section 512*a* of the second guide hole 512. In a similar manner, the fourth cover 524 is not moved in a case when the fourth guide part 528 is positioned in a first section 514*a* of the fourth guide hole 514.

In a case when the second guide part 526 is positioned in a second section 512*b* after passing through the first section 512*a* of the second guide hole 512 and when the guide plate 51 is rotated in a clockwise direction, the second cover 522 may be moved toward a central portion of the guide plate 51. A curvature of the second section 512*b* is provided in a way to be greater than a curvature of the first guide hole 511 or the third guide hole 513, and thus, at the second section 512*b*, the second cover 522 may be moved toward a central side of the guide plate 51 faster than the first cover 521 or the third cover 523.

In a case when the guide plate 51 is moved in a clockwise direction, the second cover 522 is stopped without moving in the first section 514*a* of the second guide hole 512, and when a second section 514*b* is reached, the second cover 522 is moved toward a central side of the guide plate 51. That is, the fourth cover 524, after the first cover 521 or the third cover 523 is first moved toward a central side of the guide plate 51, is then moved subsequently toward the guide plate 51 while having a certain time interval.

As the above, by having the fourth cover 524 moved while provided with a certain time interval with respect to the first cover 521 or the third cover 523, both of which are adjacent to the fourth cover 524, the discharge port 500 may be prevented from being interfered with respect to the first cover 521 or the third cover 523 at the time of when the discharge port 500 is open.

In a similar manner, in a case when the fourth guide part 528 is positioned in the second section 514*b* after passing through the first section 514*a* of the fourth guide hole 514 and when the guide plate 51 is rotated in a clockwise direction, the fourth cover 524 may be moved toward a central portion of the guide plate 51. A curvature of the second section 514*b* is provided in a way to be greater than a curvature of the first guide hole 511 or the third guide hole 513, and thus, at the second section 514*b*, the fourth cover 524 may be moved toward a central side of the guide plate 51 faster than the first cover 521 or the third cover 523.

In a case when the guide plate 51 is moved in a clockwise direction, the fourth cover 524 is stopped without moving in the first section 514*a* of the fourth guide hole 514, and when the second section 514*b* is reached, the fourth cover 524 is moved toward a central side of the guide plate 51. That is, the fourth cover 524, after the first cover 521 or the third cover 523 is first moved toward a central side of the guide plate 51, is then moved subsequently toward the guide plate 51 while having a certain time interval.

An inclination part 515 is provided at an outer side of the first guide hole 511, and thus, as much as the first cover 521 is moved toward a central side of the guide plate 51 by the first guide hole 511, the first cover 521 may be moved backward along the inclination part 515.

In a similar manner, an inclination part 516 is provided at an outer side of the third guide hole 513, and thus, as much as the third cover 523 is moved toward a central side of the guide plate 51 by the third guide hole 513, the third cover 523 may be moved backward along the inclination part 516.

Through the above, as the cover 52 is moved toward a central side of the guide plate 51, the first cover 521, the second cover 522, the third cover 523, and the fourth cover 524 may be spaced apart with respect to each other in forward/backward directions. Through the above, the first cover 521, the second cover 522, the third cover 523, and the fourth cover 524 may be prevented from being interfered with respect to each other at the time of opening the discharge port 500.

As the above, by having the fourth cover 524 moved while having a time interval with respect to the first cover 521 or the third cover 523 that are adjacent to the fourth cover 524, the fourth cover 524 may be prevented from being interfered with respect to the first cover 521 or the third cover 523 at the time of an opening of the discharge port 500.

As the guide plate 51 is rotated in a state of when the discharge port 500 is open, the cover 52 is moved toward an outer side of the guide plate 51, and thus the discharge port 500 may be closed.

The first cover 521 and the third cover 523 may be moved toward a central side of the guide plate 51 at the same time of when the guide plate 51 is rotated in a counter-clockwise direction. The second cover 522 and the fourth cover 524 as well may be moved toward a central side of the guide plate 51 at the same time of when the guide plate 51 is rotated in a counter-clockwise direction.

The second section 512*b* of the second guide hole 512, in which the second guide part 526 of the second cover 522 is moved, is provided with a curvature greater than a curvature of the first guide hole 511 or the third guide hole 513, and thus, the second cover 522 may be moved at a faster speed than the first cover 521 or the third cover 523 toward an outer side of the guide plate 51.

In a similar manner, the second section 514*b* of the fourth guide hole 514, in which the fourth guide part 528 of the fourth cover 524 is moved, is provided with a curvature greater than a curvature of the first guide hole 511 or the third guide hole 513, and thus, the fourth cover 524 may be moved at a faster speed than the first cover 521 or the third cover 523 toward an outer side of the guide plate 51.

The second cover 522 and the fourth cover 524 are placed at positions capable of closing the discharge port 500 after the second guide part 526 and the fourth guide part 528 passed through the second sections 512*b* and 514*b*. When the second guide part 526 and the fourth guide part 528 are reached at the first sections 512*a* and 514*a*, even in a case when the guide plate 51 is rotated in a counter-clockwise direction, the second cover 522 and the fourth cover 524 are not moved.

The first cover 521 and the third cover 523 may be placed at positions capable of closing the discharge port 500 in a certain period of time after the second cover 522 and the fourth cover 524 close the discharge port 500. As the above, by having the first cover 521 and the third cover 523 reached at the positions capable of closing the discharge port 500 in a certain period of time after the second cover 522 and the fourth cover 524 adjacent to the first cover 521 and the third cover 523 close the discharge port 500, the first cover 521 and the third cover 523 may be prevented from being interfered by the second cover 522 and the fourth cover 524 at the time of closing the discharge port 500.

Meanwhile, the cover 52 closing the discharge port 500 may be able to form a smooth surface having no step difference when viewed from a front.

In more detail (see FIG. 7), a first set of interference parts may be provided at mounting portions of the second cover 522. The first set of interference parts may include a first interference part 522*c* of the second cover 522 and a second interference part 522*d* of the second cover 522. The first interference part 522*c* of the second cover 522 may be formed in a protruded manner toward a front on a side of the first mounting portion 522*a* of the second cover 522. The second interference part 522*d* of the second cover 522 may be formed in a protruded manner toward a front on a side of the second mounting portion 522*b* of the second cover 522.

The first interference part 522*c* of the second cover 522 may interfere with one side of the second mounting portion 521*b* of the first cover 521 that is adjacent to the first interference part 522*c* of the second cover 522. The second interference part 522*d* of the second cover 522 may interfere with the first mounting portion 523*a* of the third cover 523 adjacent to the second interference part 522*d* of the second cover 522. When the front surface of the cover 52 forms a smooth surface having no step, the second mounting portion 521*b* of the first cover 521 and the first mounting portion 523*a* of the third cover 523 may be provided in a way to be interfered with the first and second interference parts 522*c* and 522*d* of the second cover 522.

In a similar manner, a second set of interference parts may be provided at the mounting portions of the fourth cover 524. The second set of interference parts may include a first interference part 524*c* of the fourth cover 524 and a second interference part 524*d* of the fourth cover 524. The first interference part 524*c* of the fourth cover 524 may be formed in a protruded manner toward a front on a side of the first mounting portion 524*a* of the fourth cover 524. The second interference part 524*d* of the fourth cover 524 may be formed in a protruded manner toward a front on a side of the second mounting portion 524*b* of the fourth cover 524.

The first interference part 524*c* of the fourth cover 524 may interfere with the second mounting portion 523*b* of the third cover 523 adjacent to the first interference part 524*c* of the fourth cover 524. The second interference part 524*d* of the fourth cover 524 may interfere with the first mounting portion 521*a* of the first cover 521 adjacent to the second interference part 524*d* of the fourth cover 524. When the front surface of the cover 52 forms a plane surface, the second mounting portion 523*b* of the third cover 523 and the first mounting portion 521*a* of the first cover 521 may be provided in a way to be interfered by the first and second interference parts 524*c* and 524*d* of the fourth cover 524.

As the cover 52, which is provided at the position capable of closing the discharge port 500 after moving toward an outer side of the guide plate 51, the interference parts provided at the second cover 522 and the fourth cover 524 are provided in a way to interfere with the first cover 521 and the third cover 523 at which the interference parts provided at the first cover 521 and the third cover 523, and a certain one of the covers may be provided in a way to have an inner side radius diameter and an outer side radius diameter that are identical to the adjacent cover.

Figure 10:
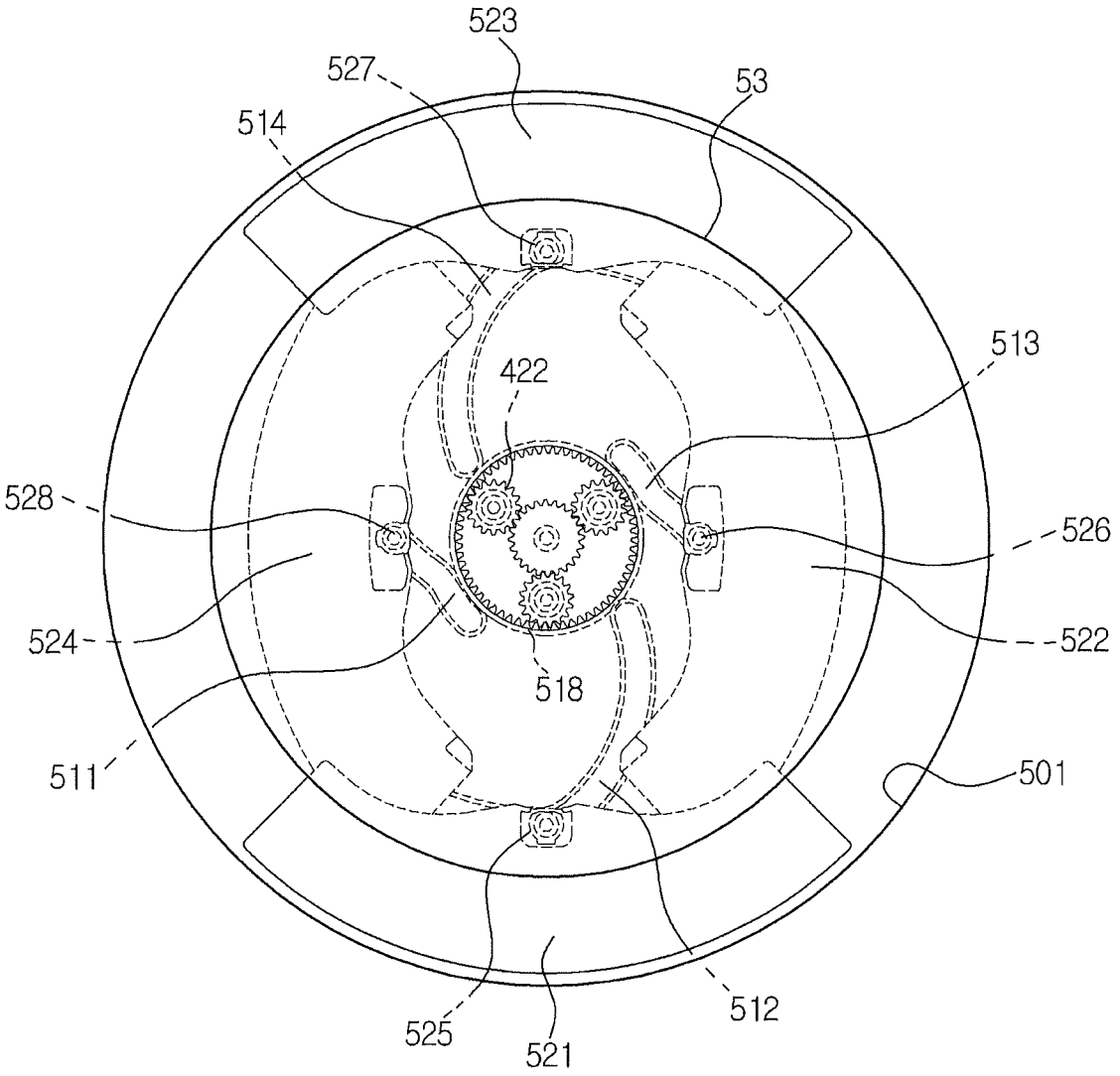
FIG. 10 is a drawing illustrating a discharge port partially open by the discharge port opening and closing apparatus in accordance with one embodiment of the present disclosure.

FIG. 10 is a drawing illustrating the discharge port partially open by the discharge port opening and closing apparatus in accordance with one embodiment of the present disclosure.

Referring to FIG. 10, the discharge port opening and closing apparatus 5 in accordance with one embodiment of the present disclosure may be able to open a portion of the discharge port 500. As one example, the discharge port opening and closing apparatus 5 may be able to open only left and right sides of the discharge port 500. As a user selects a side surface draft through a manipulation unit provided at the housing 110 or a remote control apparatus, only the covers positioned at the left and right sides of the discharge port 500 are moved toward a central side of the discharge port 500, so that the left and right sides of the discharge port 500 may be open. The air that is heat-exchanged with respect to a refrigerant may be discharged to an indoor space through the left and right sides of the discharge port 500.

For example, in a state of when the discharge port 500 is closed by the covers and when a side surface draft is selected by a user, the second cover 522 and the fourth cover 524 positioned at the left and right sides of the discharge port 500 are moved toward a central side of the discharge port 500, and the first cover 521 and the third cover 523 are not moved. The upper and lower sides of the discharge port 500 are maintained in a closed state by the first cover 521 and the third cover 523, and only the second cover 522 and the fourth cover 524 are moved toward a central side of the discharge port 500 to open the left and right sides of the discharge port 500.

In the above, an embodiment of the left and right sides of the discharge port 500 being open is described, but a case of when one of the left and right sides of the discharge port 500 is open may be present. In addition, while the first cover 521 and the third cover 523 are not moved, the second cover 522 or the fourth cover 524 is moved toward a central side of the discharge port 500, so that at least one side of the upper and lower portion of the discharge port 500 may be open.

By having portions of the guide parts 525, 526, 527, and 528 provided at a rear surface of the first cover 521 to the fourth cover 524 selectively passed through the guide holes 511, 512, 513, and 514, the portions of the guide parts 525, 526, 527, and 528 may be moved toward a central side of the discharge port 500. For example, the second guide part 526 provided at a rear surface of the second cover 522 and the fourth guide part 528 provided at a rear surface of the fourth cover 524 are passed through the second guide hole 512 and the fourth guide hole 514, respectively, while the first guide part 525 provided at a rear surface of the first cover 521 and the third guide part 527 provided at a rear surface of the third cover 523 are exited from the first guide hole 511 and the third guide hole 513, and thus, only the second cover 522 and the fourth cover 524 may be controlled to be moved toward a central side of the discharge port 500 by the driving force of the motor 42'. The method of having the portions of the first cover 521 to the fourth cover 524 moved is not limited hereto.

As the above, when the discharge port 500 is closed by the cover 52, by having the front surface of the cover 52 form a smooth surface provided with no step, the esthetic beauty of the exterior appearance of the indoor unit 1 may be enhanced. With respect to the guide holes configured to guide the covers, as the first guide holes each having the shape of a spiral and the second guide holes having the first section and the second section are alternatively disposed, the plurality of covers 52 may be sequentially driven while having a time interval. Assuming that the first cover 522 and the third cover 523 are referred to as a first group of covers and that the second cover 522 and the fourth cover 524 are referred to as a second group of covers, after the first group of the covers is moved, then, sequentially, the second group of the covers are moved, and thus, the width of an opening of the discharge port 500 may be varied.

Assuming that the position at which the plurality of covers closes the discharge port 500 is referred to as a first position and that the position at which the discharge port 500 is open is referred to as a second position, the area that is overlapped with respect to the adjacent covers at the time of when the plurality of covers is only in the second position is greater than the area that is overlapped with respect to the adjacent covers at the time of when the plurality of covers is only in the first position.

By having the at least one cover is spaced apart in forward/backward directions with respect to the adjacent cover while moving along the inclination part provided at an outer side at the time of moving to an inner side of the guide plate 51, the cover being interfered with respect to the adjacent cover may be prevented at the time of opening/closing the discharge port 500.

In addition, as the cover adjacent to the interference part provided at one end portion of the cover is interfered, the plurality of covers form an even surface while provided with an identical inner side diameter and an identical outer side diameter, and thus, the step difference of the covers is improved, and at the same time, the finishing quality of the discharge port opening and closing apparatus may be enhanced.

As is apparent from the above, in accordance with the present disclosure, an air conditioner having a discharge port opening and closing apparatus is configured in a way that a plurality of covers configured to open/close a discharge port is sequentially moved so that the width of an opening of the discharge port may be adjusted, and also, as the covers are moved, the covers are moved toward/backward in a front or rear direction of the discharge port, the covers may be positioned in a overlapped manner in a way not to be interfered with respect to each other at a central side of the discharge port in a state when the discharge port is completely open.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. An apparatus for opening and closing a discharge port for discharging air, the apparatus comprising:

a plurality of covers configured to move in a radial direction of the discharge port while covering at least a portion of the discharge port; and a guide plate connected to the plurality of covers and configured to rotate from a first position to a second position, and from the second position to a third position, wherein a width of an opening of the discharge port is varied as the plurality of covers are moved, a first cover of the plurality of covers maintains a fixed position in the radial direction as the guide plate is rotated from the first position to the second position, to avoid an interference of the first cover with a second cover of the plurality of covers as the guide plate is rotated from the first position to the second position, and the first cover and the second cover move in the radial direction as the guide plate is rotated from the second position to the third position.

2. The apparatus of claim 1, wherein a first group of the plurality of covers are configured to simultaneously move in a radial direction of the discharge port.

3. The apparatus of claim 1, wherein a first group of covers of the plurality of covers are symmetrically positioned to each other with respect to a center of the discharge port.

4. The apparatus of claim 2, wherein:

a second group of covers of the plurality of covers are configured to simultaneously move in a radial direction of the discharge port, the width of the opening of the discharge port is varied as the second group of covers is moved sequentially after the first group of covers is moved.

5. The apparatus of claim 1, wherein at least one of the plurality of covers at least partially overlaps another one of the plurality of covers adjacent to the at least one of the plurality of covers.

6. The apparatus of claim 1, wherein when at least one of the plurality of covers moves in the radial direction of the discharge port, the distance in between the discharge port and the at least one of the plurality of covers becomes closer or farther.

7. The apparatus of claim 1, further comprising a motor configured to provide a driving force such that the plurality of covers are moved.

8. The apparatus of claim 7, further comprising a gear part configured to change the speed of the motor.

9. The apparatus of claim 7, wherein the guide plate is configured to rotate by receiving a rotational force of the motor.

10. The apparatus of claim 9, further comprising a plurality of guide holes corresponding to the plurality of covers, respectively, formed at the guide plate, and a guide part passing through at least one of the plurality guide holes is formed on at least one of the plurality of covers.

11. The apparatus of claim 10, wherein:

at least one of the plurality of guide holes comprises a first section extended along an arc concentric to the discharge port, and a second section extended from the first section toward a center of the arc, and if the guide part is positioned within the first section during a rotation of the guide plate, the first cover of the plurality of covers is not moved, and if the guide part is positioned within the second section during the rotation of the guide plate, the first cover of the plurality of covers is moved.

12. The apparatus of claim 10, further comprising a rail plate comprising a plurality of rails corresponding to the plurality of covers, respectively, are formed to support the guide part of the at least one of the plurality of covers.

13. The apparatus of claim 1, wherein the discharge port has a circular shape.

14. The apparatus of claim 1, wherein the plurality of covers sequentially move.

15. An air conditioner comprising:

a discharge port for discharging air;

a plurality of covers to cover the discharge port; and a guide plate connected to the plurality of covers and configured to rotate from an initial position to a final position, wherein each of the plurality of covers is configured to cover a region of the discharge port, at least two of the plurality of covers move from a first position capable of covering a region corresponding to the discharge port to a second position capable of opening the region corresponding to the discharge port by the rotation of the guide plate from the initial position to the final position, while a first cover of the at least two of the plurality of covers moves from the first position to the second position, a second cover of the at least two of the plurality of covers is controlled to be maintained in the first position during a first interval of the movement of the first cover from the first position to the second position to avoid an interference of the first cover with the second cover as the first cover moves from the first position to the second position, and move from the first position to the second position during a second interval of the movement of the first cover from the first position to the second position, and the first cover is configured to move in a radial direction of the discharge port.

16. The air conditioner of claim 15, wherein when the first cover starts to move from the first position to the second position, the second cover starts to sequentially move from the first position to the second position.

17. The air conditioner of claim 15, wherein each of the plurality of covers is able to move from the first position to the second position.

18. The air conditioner of claim 17, wherein a first group of covers of the plurality of covers are configured to simultaneously move.

19. The air conditioner of claim 18, wherein the first group of covers are symmetrically positioned to each other with respect to a center of the discharge port.

20. The air conditioner of claim 17, wherein each of the plurality of covers moves in a radial direction of the discharge port.

21. The air conditioner of claim 15, wherein when the first cover moves in a radial direction of the discharge port, a distance in between the discharge port and the first cover is farther or closer.

22. The air conditioner of claim 15, wherein a distance in between a center of the discharge port and a center of the first cover when the first cover is at the second position is smaller than a distance between the center of the discharge port and the center of the first cover when the first cover is at the first position.

23. The air conditioner of claim 15, wherein the discharge port has a circular shape.

24. The air conditioner of claim 15, wherein the second cover moves based on a position of a guide part on the at least one of the plurality of covers.

25. The air conditioner of claim 15, wherein the plurality of covers form a smooth surface without being disconnected when the plurality covers are moved to the second position.

26. An air conditioner comprising:

a discharge port for discharging air;

a plurality of covers to cover the discharge port; and a guide plate connected to the plurality of covers and configured to rotate from a first position to a second position, and from the second position to a third position, wherein:

a first cover of the plurality of covers maintains a fixed position in the radial direction as the guide plate is rotated from the first position to the second position, to avoid an interference of the first cover with a second cover of the plurality of covers as the guide plate is rotated from the first position to the second position, and the first cover and the second cover move in the radial direction as the guide plate is rotated from the second position to the third position.

27. The air conditioner of claim 26, wherein the discharge port has a circular shape.

28. An apparatus for opening and closing a discharge port for discharging air, the apparatus comprising:

a plurality of covers configured to move in a radial direction of the discharge port; and a guide plate connected to the plurality of covers and configured to rotate from a first position to a second position, and from the second position to a third position, wherein the discharge port is open when the plurality of covers move towards a center of the discharge port and the discharge port is closed when the plurality of covers are extended to a predetermined position from the center of the discharge port, a first cover of the plurality of covers maintains a fixed position in the radial direction as the guide plate is rotated from the first position to the second position, to avoid an interference of the first cover with a second cover of the plurality of covers as the guide plate is rotated from the first position to the second position, and the first cover and the second cover move in the radial direction as the guide plate is rotated from the second position to the third position.

* * * * *